US005433688A

United States Patent [19]

Davies

[11] Patent Number: 5,433,688

[45] Date of Patent: Jul. 18, 1995

[54] EXERCISE DEVICE WORN ON THE USER'S BODY HAVING RESILIENT RESISTANCE MECHANISMS

[76] Inventor: Phillip H. Davies, 1660 N. LaSalle St. #3407, Chicago, Ill. 60614

[21] Appl. No.: 67,694

[22] Filed: May 26, 1993

Related U.S. Application Data

[63] Continuation-in-part of Ser. No. 872,983, Apr. 24, 1992, abandoned.

[51] Int. Cl.[6] ..... A63B 21/02

[52] U.S. Cl. ..... 482/124; 482/74; 482/126; 482/139

[58] Field of Search ..... 482/74, 121, 122, 124, 482/126, 139, 125

[56] References Cited

U.S. PATENT DOCUMENTS 2,035,010 3/1936 Rawlings ..... 482/124
3,162,441 2/1960 Karlik .
4,540,173 9/1985 Hopkins .
4,685,671 8/1987 Hauerman et al. .
4,733,862 3/1988 Miller ..... 482/126
4,993,705 2/1991 Tölle .

FOREIGN PATENT DOCUMENTS 0020463 of 1908 United Kingdom .
0245274 1/1926 United Kingdom ..... 482/124

*Primary Examiner*—Lynne A. Reichard
*Attorney, Agent, or Firm*—John P. Moran

[57] ABSTRACT

An exercise device for exercising a user's upper body, including a belt mountable around the user's waist, an elastic cord secured at a midpoint thereof to the front portion of the belt, and gripping members operatively connected to the respective ends of the elastic member. The gripping members may include a hand grip only, a wrist cuff only, or both a hand grip and a wrist cuff, either as separate members or as an integral unit. As an alternate embodiment, the belt may be a two piece belt connected at the front ends thereof by a cord adjuster plate, with the elastic cord adjustably secured to the belt by an anchor.

20 Claims, 8 Drawing Sheets

EXERCISE DEVICE WORN ON THE USER'S BODY HAVING RESILIENT RESISTANCE MECHANISMS

This application is a continuation-in-part application of Ser. No. 872,983, filed Apr. 24, 1992, now abandoned.

TECHNICAL FIELD

This invention relates generally to a stretchable athletic device and, more particularly, to such a device for the upper body, especially the shoulders and arms, used while running, jogging, walking, aerobics or during other activities.

BACKGROUND ART

Stretchable athletic devices that can be used for exercising the upper body are generally known in the art. Heretofore, these exercise devices have been limited in their use while running and walking, and during aerobics and related indoor exercises, because the devices were overly complicated or were not designed to handle the full range of arm motions involved in such exercises. For example, U.S. Pat. No. 4,993,705 to Telle (1991) includes a vest to protect the user from two straps which stretch across the user's shoulders and back when using this device.

U.S. Pat. No. 4,685,671 to Atkins et al discloses a multi-purpose device for exercising arms and legs. Its stated use is for indoor exercise, primarily muscular exercise. It is not designed for the back and forth, or push pull, arm movements of running and walking. This invention's belt attachment fastener for connecting an elastic member is a loose loop of NYLON material, designed mainly for attaching the exerciser to a closed door. The result of using this fastener to attach the middle of the exercise cord to the belt is that the elastic member is not held securely to the belt. The elastic member uncomfortably snaps across the front and sides of the user's stomach during the arm movements of running and other exercises.

A number of stretchable arm exercise devices have elastic members that attach to the two sides of a user's belt, i.e., the devices have two separate attachment points, one on each side of the user's body. These devices allow for comfortable use only when arms are being extended together in the same direction forward or backward. When arms are going in opposite directions (i.e., one arm forward while one arm backward), which is the normal arm movement of running or walking, the two separate attachment points cause the belt to be rotated back and forth around the user's midsection. The result is an uncomfortable rubbing and chafing on the user's waist. One such device is U.S. Pat. No. 4,540,173 to Hopkins (1985).

Longhurst British Patent No. A.D. 1907 discloses a device suitable for use as an elbow guide in teaching the game of golf including a loop of leather attached in a suitable manner to the back of a golfer's belt, with a fixed length (i.e., inelastic) leather strap slidably mounted through the loop and extending to elastic loops at the ends thereof for slipping over the golfer's arms at or near the elbows.

U.S. Pat. No. 3,162,441 to Karlik (1964) discloses an exercise device including a cord mounted around a plurality of pulleys associated with three springs, with handles and stirrups connected to four ends of the cord for use by the user while lying down or standing.

DISCLOSURE OF THE INVENTION

A general object of the invention is to provide an improved exercise device for exercising the upper body, especially the shoulders and arms, during running, jogging, walking, aerobics, roller skating, riding a stationary bicycle, running in place and other exercises, turning these activities into a total body workout. The advantage of such a workout is that all major muscle groups are involved to a high degree, increasing the user's overall aerobic exercise and his or her upper body muscular exercise.

Another object of the invention is to provide an exercise device including a waist belt worn by the user, an elongated elastic member, the middle of which is attached to the front of the belt, wrist cuffs and/or hand grips to attach the ends of the elastic member to each arm, and alternatively a cord length-adjustment member, positioned either at the belt or at each of the hand grips.

A further object of the invention is to provide an exercise device having a balanced amount of resistance on shoulders and arms throughout their natural forward and backward movements while running or walking, or during other uses. The user's arms are exercised equally in both directions. Moreover, the amount of tension and resistance can be changed to meet a wide range of user requirements, since the length of the elastic member can be quickly and easily adjusted, which is a key difference between this exerciser and any patents in the field. Users can adjust the cord length without stopping their workout, such as a jogging or walking workout.

Another object of the invention is to provide a multitude of uses. This exercise device can be used while doing aerobics, adding a resistance workout to arm movements. Likewise, this device can be used while jogging in place, providing a number of different arm exercises. For all exercises, arms can be extended straight in front of the user, out to the sides, up above the user's head, to the back of the user, as well as movements in other directions. During these movements, arms can be moved in the same direction or in opposite directions. These arm exercises can be done while the user is walking, running or performing other exercises, such as aerobics, riding a stationary bicycle, as well as while the user is standing or sitting.

Still another object of the invention is to provide an upper body athletic device including a belt having a single point of attachment for an elastic member, which ensures comfortable use during all arm movements and prevents the belt from rubbing back and forth on the user's waist when arms are moved in opposite directions from each other.

A still further object of the invention is to provide an upper body athletic device including an elastic member having a fixed point of attachment to the front of the waist belt. The secured attachment of the elastic member to the waist belt prevents the elastic member from snapping against and stretching across the user's body. As a result, this device can be comfortably used, even when the user is not wearing a shirt.

A still further object of the invention is to provide a cord length adjustment plate on the belt for securing the cord to the belt and for adjusting the length of the cord from the belt to the hand grips and/or wrist cuffs.

A still further object of the invention is to provide such an athletic device wherein the arm attachment consists of a wrist cuff combined with a hand grip. As such, the tension placed on the arms is distributed across the wrists and the hands, eliminating forearm and hand muscle fatigue. Also, the combination of the wrist cuff and hand grip hold each other in place, which prevents the exercise device from rubbing the user's arms, permitting this exercise device to be comfortably used.

Still another object of the invention is to provide an exercise device having a readily and easily usable buckle attached belt, and wrist cuffs that are secured to the arms using hook and loop fasteners. The device is easy to assemble and inexpensive to manufacture.

Further objects and advantages of this invention will become apparent when reference is made to the drawings and the accompanying description.

BEST MODE OF CARRYING OUT THE INVENTION

Figure 1:
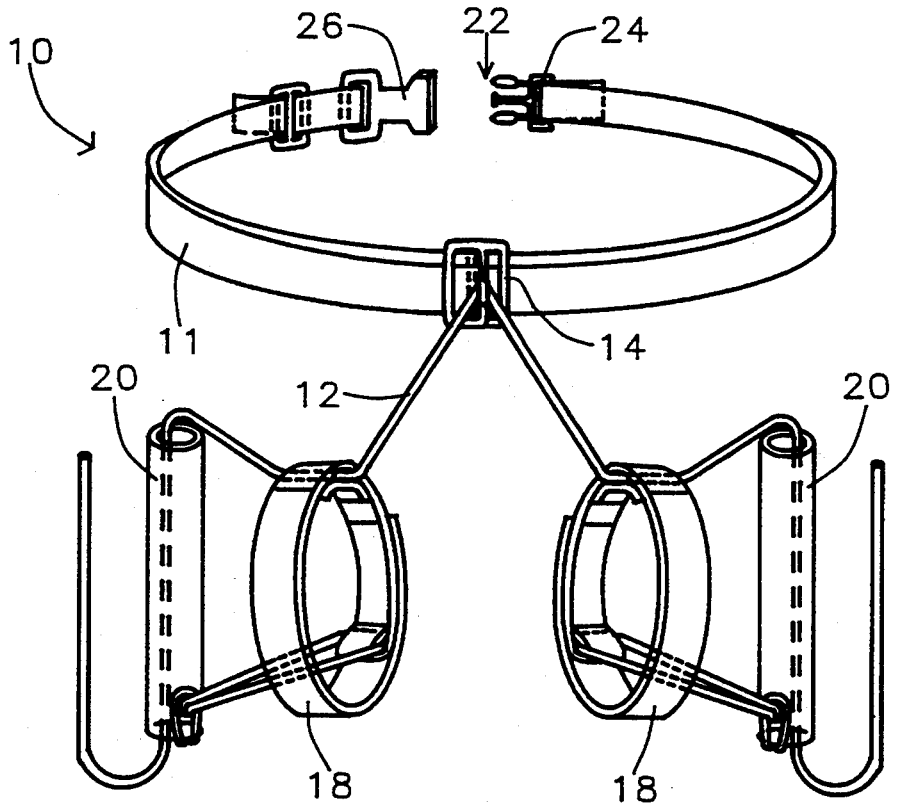
FIG. 1 is a perspective view of the inventive exercise device including wrist cuffs and hand grips.

Referring now to the drawings in greater detail, FIG. 1 illustrates an exercise device 10 for the upper body, especially the arms, shoulders and hands, designed to be worn on a user's waist and attached to the user's hands, and alternatively to the user's wrists. The exercise device 10 includes a waist belt 11 worn by the user, an elastic cord 12, the middle of which is attached to the belt with a belt fastener 14 that is located in the front center of the belt, and two wrist cuffs 18 and hand grips 20, attached to the respective ends of the elastic member.

The waist belt 11 is composed of standard woven NYLON material and has a conventional release belt buckle 22, such as the type having a clasp member 24, which is inserted into and locked in a receptacle member 26. The belt buckle 22 is removably attached to the waist belt 11, allowing the length of the belt to be easily adjusted.

The belt fastener 14 attaches the elastic cord 12 securely to the waist belt 11. The belt fastener 14 is composed of durable plastic and is securely attached to the front center of the waist belt 11.

The elastic cord 12 is composed of rubber latex tubing of various diameters and lengths, in order to meet a wide range of user requirements. The elastic cord 12 is attached at its midpoint to the belt fastener 14 by looping the elastic cord 12 around and through the fastener 14, serving to retain the elastic cord 12 securely in place, while allowing adjustments to the length thereof using the handgrips.

Figure 2:
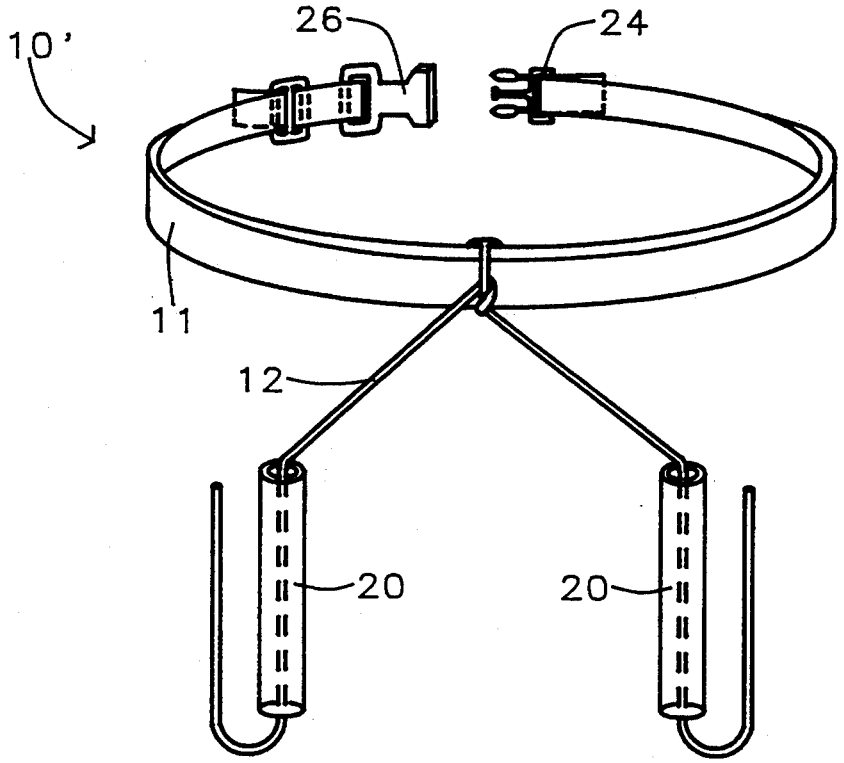
FIG. 2 is a perspective view of an alternate embodiment of the device including only hand grips and no wrist cuffs or belt fastener.

In FIG. 2, an alternate embodiment of an exercise device 15 is shown. In this embodiment, the elastic cord 12 is securely attached directly to the waist belt 11, without using the belt fastener 14. The arm attachments consist of hand grips 20 only.

Figure 3:
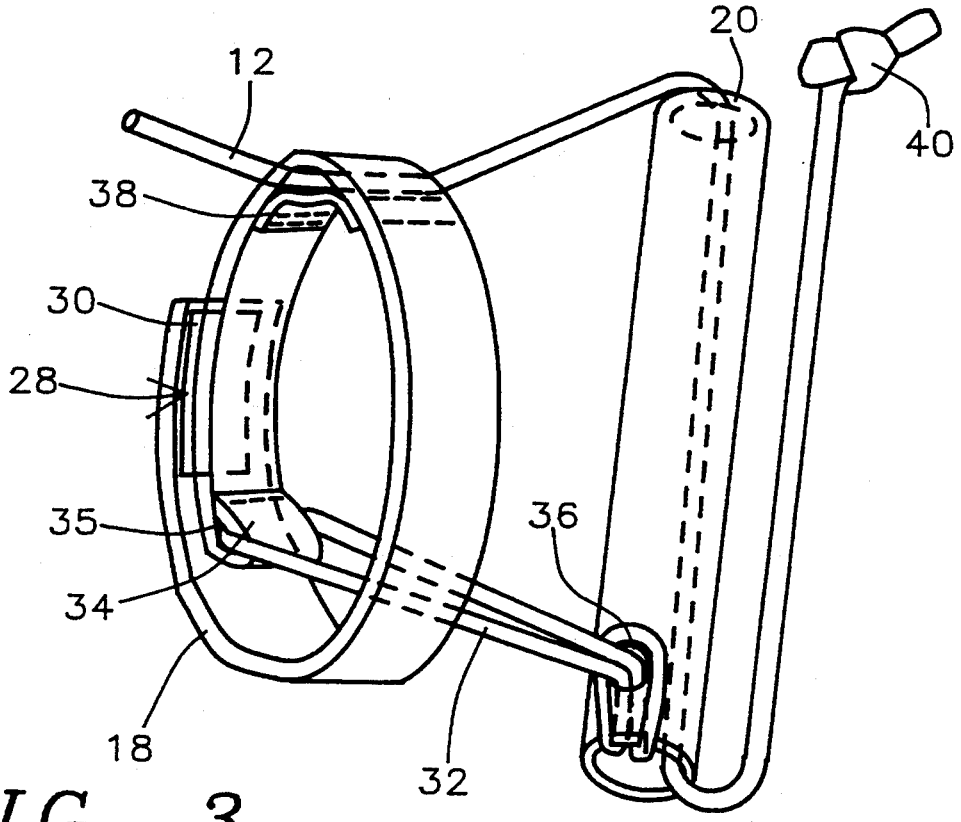
FIG. 3 is an enlarged perspective view of the wrist cuff and hand grip portion of FIG. 1.

In FIG. 3, the wrist cuff 18 and hand grip 20 of FIG. 1 are shown in more detail. The hand grip 20 is a light weight, hollow handle, typically formed of plastic. The wrist cuff 18 is formed of a woven NYLON material, which loosely fits around the base of the user's hand and is removably attached by means of a cuff latch 28, such as VELCRO, or suitable hook and loop fastener strips 30. A non elastic cord 32, made of NYLON rope, or the like, serves to interconnect the wrist cuff 18 and the hand grip 20. Specifically, the end 34 of the cuff 18 is folded over and stitched to form an opening 35 through which the cord 32 is extended. An opening 36 is formed through the wall of the hand grip 20 adjacent the bottom end thereof, through which the cord 32 is extended and tied. A guide 38 formed of a woven NYLON strap is secured at its ends to a predetermined location on the inside of the cuff 18, such as by stitching in a manner which projects the center of the guide away from the adjacent cuff 18 surface to form an opening 39 therebetween, through which the elastic cord 12 is removably extended.

The elastic cord 12 is extended through the opening 39 between the wrist cuff 18 and the elastic member guide 38, and, thence, through the hollow hand grip 20. The elastic cord 12 exits the hand grip 20 at the bottom end thereof and extends another 6–10 inches. A cord knot 40 may be tied at the end of the elastic cord 12. The elastic cord 12 is held in the user's hand along with the hand grip 20. Very little user effort is required to hold the elastic cord 12 to prevent it from slipping during exercise, since the numerous friction points of the wrist cuff 18 and hand grip 20 hold the elastic cord 12 in place. The length of the elastic cord 12 between the belt 11 and wrist cuff 18 can be adjusted to increase or decrease the amount of resistance during use of the exercise device.

If preferred, the cord knot 40 may be tied at the point where the elastic cord 12 exits the bottom of the hand grip 20. The extra length of the elastic cord 12 may be cut off in this configuration.

Figure 4:
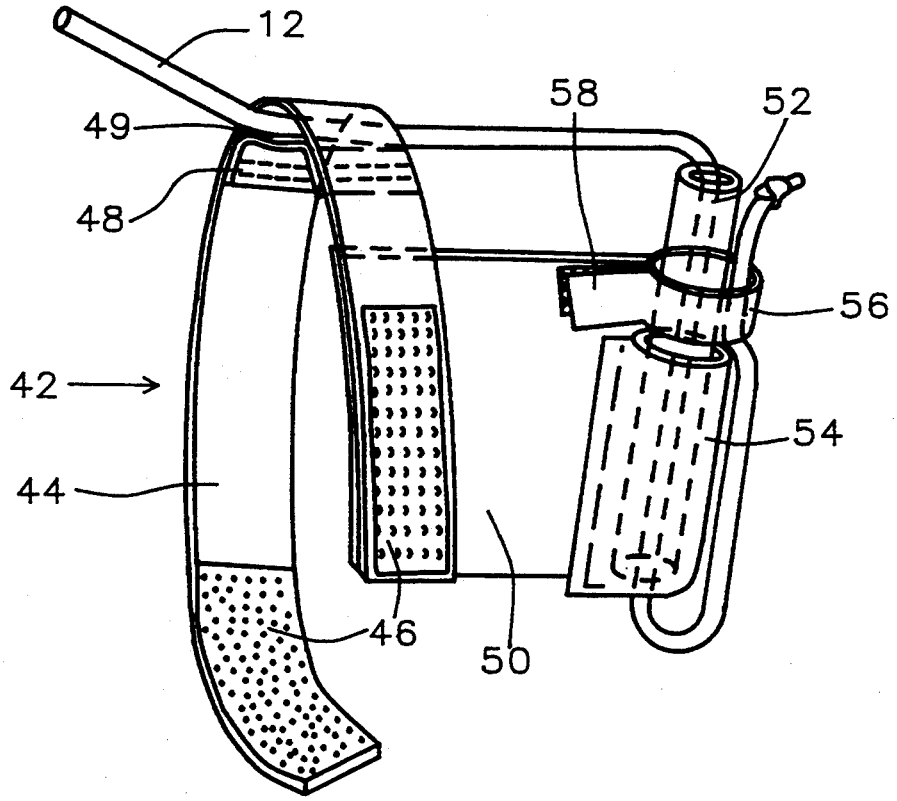
FIG. 4 is an enlarged perspective view of an alternative one piece wrist cuff/hand grip.

Referring now to FIG. 4, still another embodiment of the invention is shown. In this arrangement, a one piece wrist cuff/hand grip 42 is shown. The wrist cuff/hand grip 42 includes a woven NYLON wrist cuff 44 attached to one end of a woven NYLON or polyester cuff/grip body 50. A plastic hand grip 52 is operatively connected to the other end of the body 50. The wrist cuff 44 is secured around the user's wrist by mating hook and loop strips mounted on the respective ends thereof, and serving as a cuff latch 46. A guide 48 is secured to a predetermined midpoint of the wrist cuff 44, providing an opening 49 through which the elastic cord 12 is extended to the hand grip 52. The palm side of the attached wrist cuff 44 is sewn to the one end of the cuff/grip body 50. The cuff/grip body 50 includes a grip holster 54 secured to the other end thereof, into which the attached hand grip 52 is mounted. A flexible grip lock strip 56 is secured at one end thereof to an upper portion of the body 50, and adapted to removably retain the elastic cord 12 and the hand grip 52 in place relative to the grip holster 54 by wrapping around same and having the free end of the grip lock 56 removably attached to the secured end by any suitable hook and loop means 58, such as VELCRO.

Figure 5:
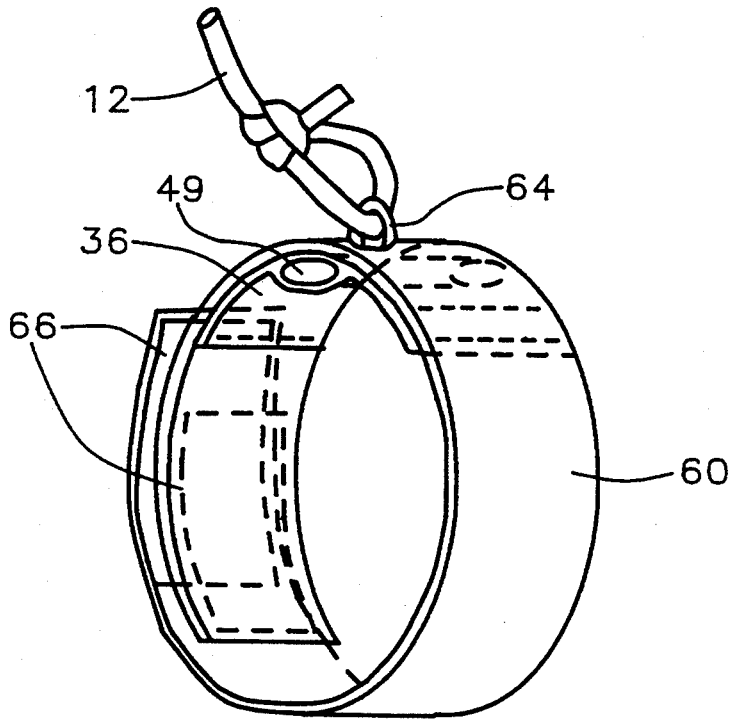
FIG. 5 is an enlarged perspective view of a wrist cuff with no hand grip.

Referring to FIG. 5, a still further embodiment of the invention is shown. This arrangement includes an arm cuff 60 only. The hand grip is not used. The elastic cord 12 is attached to the arm cuff 60 by means of a ring fastener 64 secured to the arm cuff in lieu of extending through the guide 36. In this embodiment, the arm cuff 60 is removably attached around the user's arm with an arm cuff latch 66 similar to the cuff latch 46 of FIG. 4.

Figure 6:
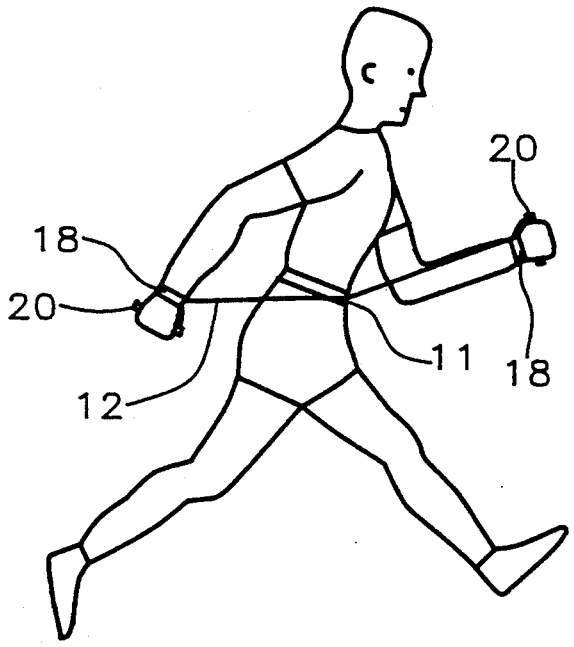
FIGS. 6 and 7 are perspective views of a user employing the exercise device in two operational modes.

In FIG. 6, the exercise device 10 is shown being used while the user is running. The most common arm movement while running is the normal back and forth arm movement. However, a runner could perform other arm movements, such as moving arms out to the side or above the head, in order to exercise selected muscles of the arms and shoulders.

Figure 7:
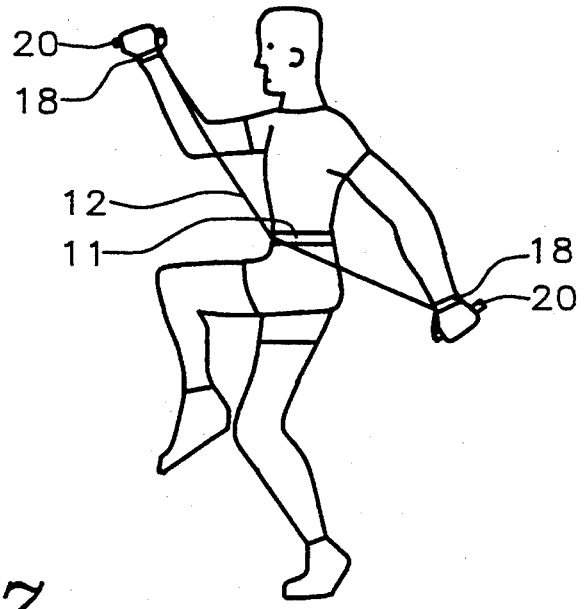

In FIG. 7, the exercise device is shown being used while the user is doing aerobics. For this type of exercise, the user often wants to raise arms over his or her head, so the length of the elastic cord 12 between the belt 11 and each wrist cuff 18 can be increased.

Figure 8:
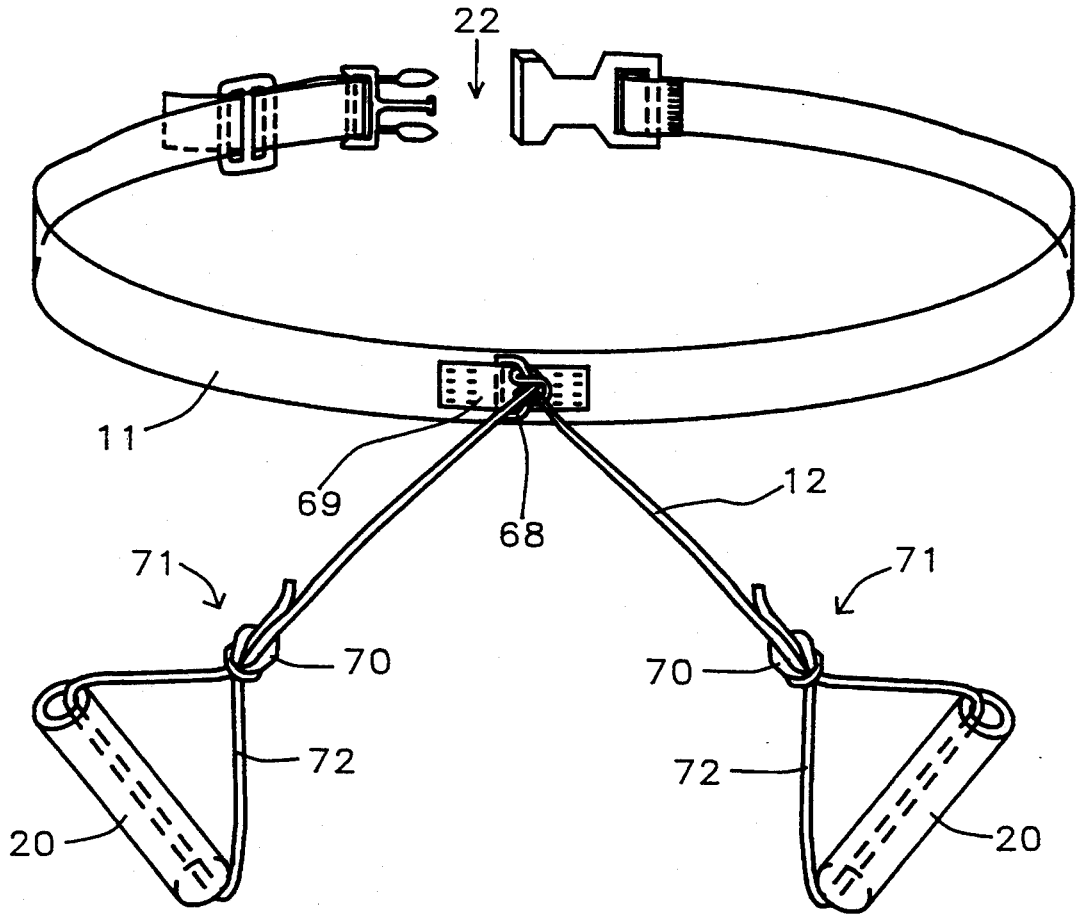
FIG. 8 is a perspective view of an alternate embodiment of the device including a belt, a belt fastener, an elastic cord and hand grips.

In FIG. 8, an alternate embodiment of the exercise device is shown, represented as 70. The exercise device 70 is designed to be worn on a user's waist and attached to the user's hands, and alternatively, to the user's wrists. The exercise device 70 includes the waist belt 11 worn by the user, the release buckle 22, the elastic cord 12, the middle of which is attached to the belt with a standard D fastener 72 that is sewn to the front center of the belt by a NYLON fastening strap 74, and two hand grips 20 attached to the respective ends of the elastic cord 12 by NYLON grip straps 76, as will be explained.

The standard D fastener 72 attaches the elastic cord 12 securely to the waist belt 11. The standard D fastener 72 is composed of durable plastic and is securely attached to the front center of the waist belt 11 with the NYLON fastening strap 74.

The elastic cord 12 is composed of rubber latex tubing of various diameters and lengths, in order to meet a wide range of user requirements. The elastic cord 12 is attached at its midpoint to the standard D fastener 72 by looping the elastic cord 12 through the standard D fastener 72 and around the elastic cord 12, serving to retain the elastic cord 12 securely in place.

Figure 11:
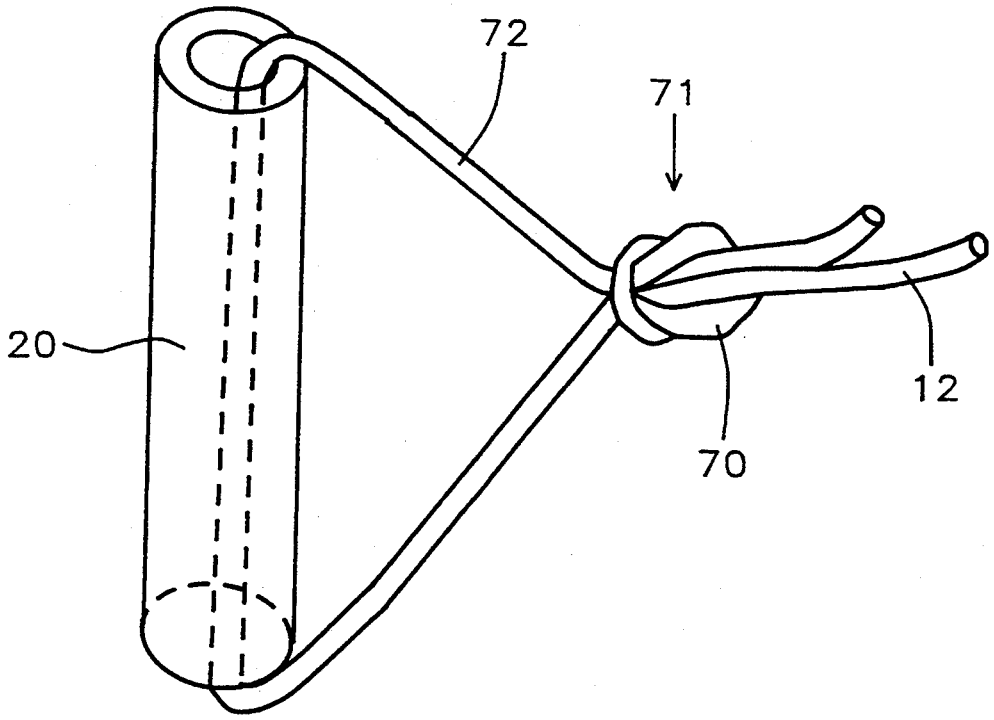
FIG. 11 is an enlarged view of the hand grip of FIGS. 8 and 9.

As best shown in FIG. 11, each NYLON grip strap 76 is looped through one of the hand grips 20 and sewn together at the ends 78 thereof, to assume a substantially triangular shape, with a loop 80 formed beyond the sewn ends 78, through which the elastic cord 12 is looped and wrapped around the juncture of the sewn ends 78 and the loop 80.

Figure 9:
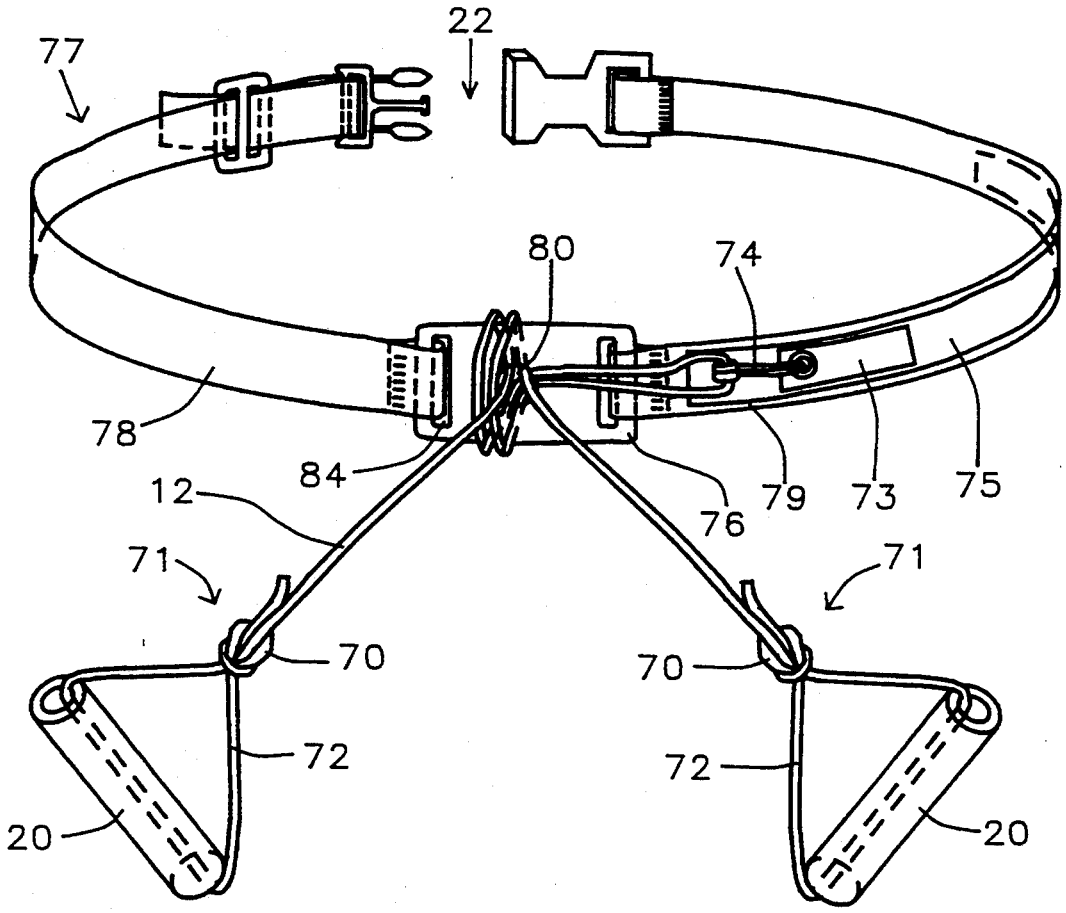
FIG. 9 is a perspective view of another alternate embodiment of the device including a cord adjuster fastener plate and cord anchor.

In FIG. 9, a further alternate embodiment of the exercise device is shown as 82. The exercise device 82 is designed to be worn on a user's waist and attached to the user's hands, and alternatively, to the user's wrists. The exercise device 82 includes a two-piece belt 84 interconnected by a cord adjuster plate 86. A belt loop fastener strip 88 is secured to one of halves of the two-piece belt 84. An elastic cord 12 that is looped through and around the cord adjuster plate 86 and attached to the belt loop fastener strip 88 by a cord hook fastener strip anchor 90. Two hand grips 20 are attached to the respective ends of the elastic cord 12 by NYLON grip straps 76, as explained above relative to the FIG. 8 structure.

Figure 10:
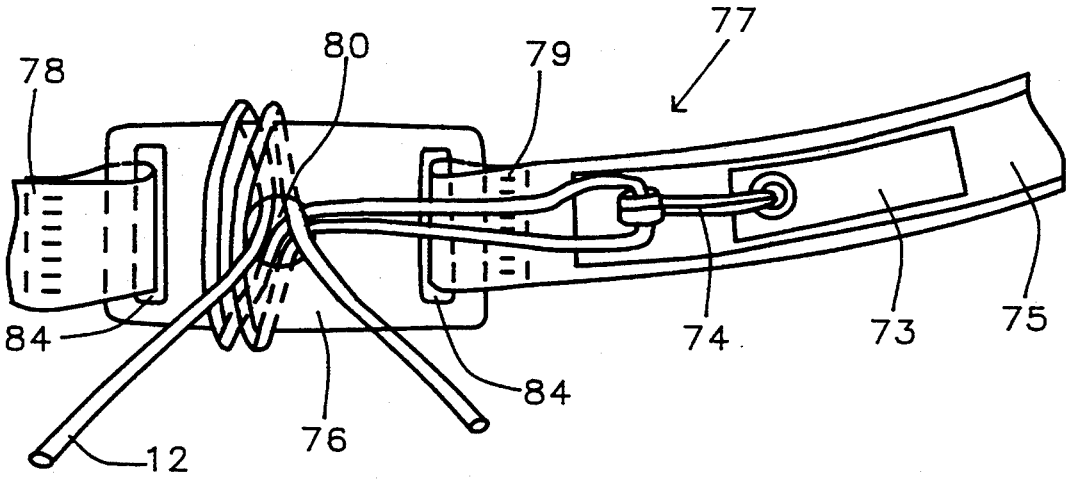
FIG. 10 is an enlarged view of the front of the exercise belt of FIG. 9.

In FIG. 10, an enlarged perspective view of the front of the two piece belt 84 is shown. The cord adjuster plate 86 is composed of durable, flexible plastic and includes a plate center hole 92 and belt fastener slots 94 at opposite ends of the cord adjuster plate 86. One end of the belt 84 is securely sewn around one belt fastener slot 94 and a second end of the belt 84 is securely sewn around the other belt fastener slot 94.

The elastic cord 12 is composed of rubber latex tubing of various diameters and lengths, in order to meet a wide range of user requirements. The cord hook fastener strip anchor 90 is attached to the midpoint of the elastic cord 12 by an anchor tie 96.

The elastic cord 12 is removably secured to the cord adjuster plate 86 by placing the midpoint of the elastic cord 12 through the plate center hole 92 and looping the elastic cord 12 completely around the cord adjuster plate 86 and pulling the elastic cord 12 back through the plate center hole 92. The elastic cord 12 is secured to the belt 84 by pressing the cord hook fastener strip anchor 90 against the belt loop strip fastener 88.

The length of the elastic cord 12 between the cord adjuster plate 86 and the hand grips 20 is easily adjusted by unfastening the cord hook fastener strip anchor 90 from the belt loop fastener strip 88, repositioning the elastic cord 12 around the cord adjuster plate 86 and refastening the cord hook fastener strip anchor 90 to the belt loop fastener strip 88. The belt loop fastener strip 88 is of such a length to allow the cord hook fastener strip anchor 90 to be fastened at a number of different points along the belt loop fastener strip 88, thus providing a quick cord length adjustment feature for the exercise device 84.

In FIG. 11, an enlarged perspective view of the hand grip of FIGS. 8 & 9 is shown.

Figure 12:
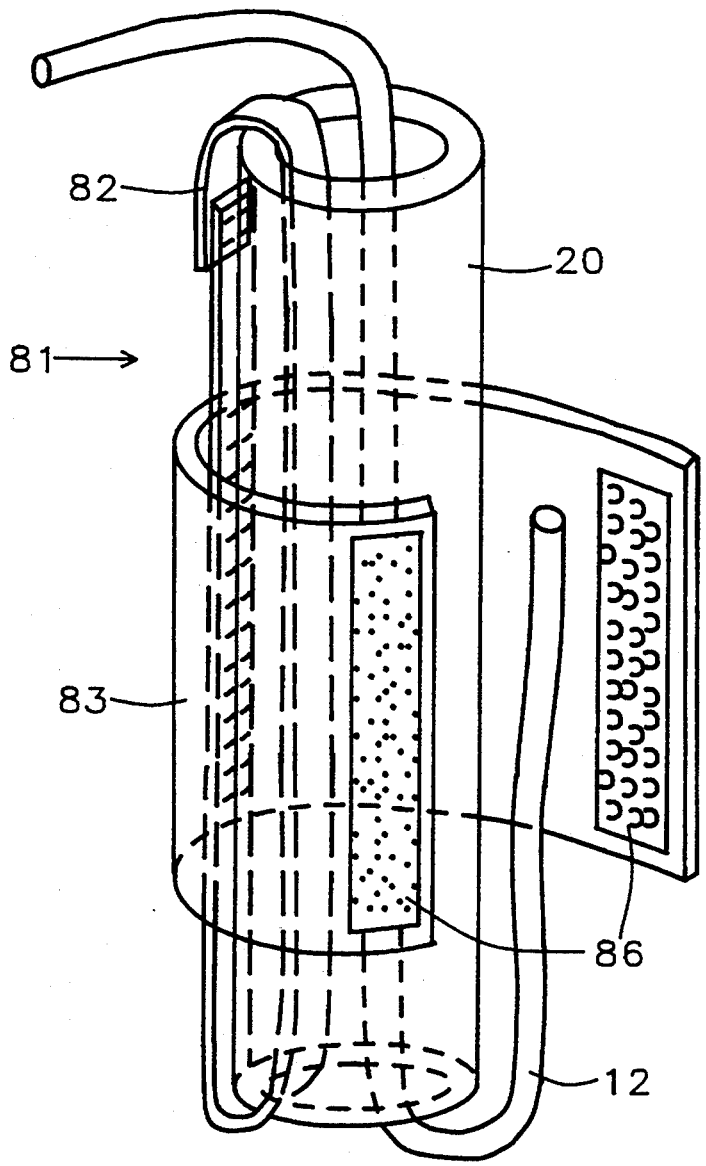
FIG. 12 is a perspective view of an alternative hand grip, including a cord adjuster fastener.
Figure 13:
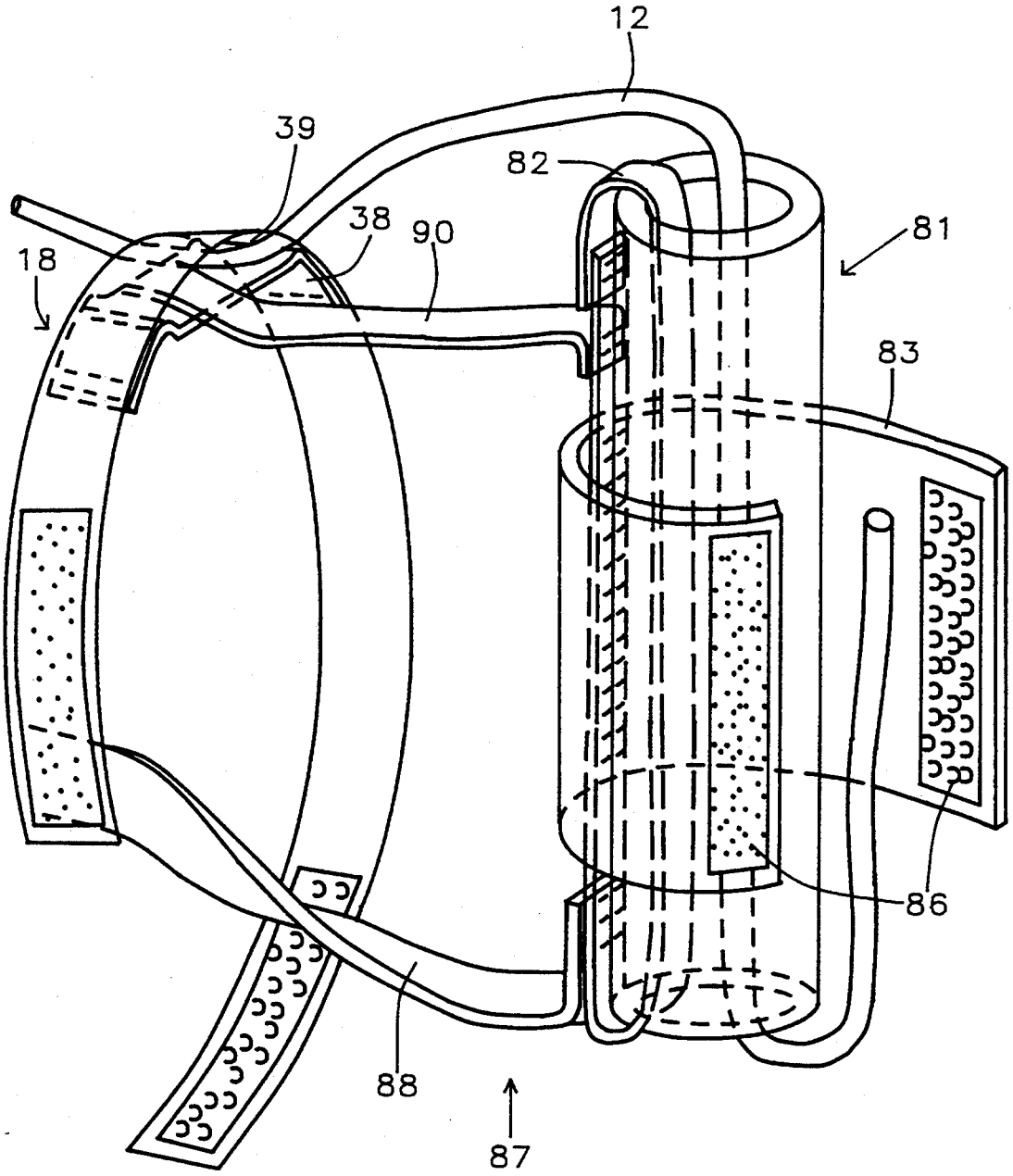
FIG. 13 is a perspective view of an alternate one piece, integrated cuff and hand grip.

In FIG. 12, an alternate embodiment of a hand grip 98 is shown, including a hand grip strap 100 and a cord adjuster fastener 102. One end of the hand grip strap 100 goes through the hand grip 98 and is then sewn to the other end of the hand grip strap 100. The cord adjuster fastener 102 is rectangular in its flat shape, with its middle sewn to the hand grip strap 100 on the outside of the hand grip 98. The cord adjuster fastener 102 encircles the hand grip 98. A hook and loop fastener 104 is sewn to the cord adjuster fastener 102. The elastic cord 12 is placed through the hand grip 98, and the portion of the elastic cord 12 coming out the other end of the hand grip 98 is adjustably and removably secured to the hand grip 98 by encircling the hand grip 98 and the elastic cord 12 with the cord adjuster fastener 102 and fastening the hook and loop fastener 104. In FIG. 13, another embodiment of the integrated cuff and hand grip 106 is shown. The integrated cuff and hand grip 106 includes the hand grip 98 of FIG. 12 and the wrist cuff 18 of FIG. 3, without the hand grip attachment cord 32 or the cuff end 34 of FIG. 3. The wrist cuff 18 is securely attached to the hand grip 98 using two NYLON connecting straps, a lower connector strap 108 and an upper connector strap 110. The upper connector strap 110 is sewn to the guide 38 of the wrist cuff 18 and to the hand grip strap 100, near the top of the hand grip 98. The lower connector 108 is sewn to the bottom of the wrist cuff 18 and to the hand grip strap 100, near the bottom of the hand grip 98.

While several embodiments of the invention have been shown and described, other modifications thereof are possible within the scope of the following claims.

I claim:

1. An exercise device for the upper body of a user, the exercise device comprising belt means adapted to being worn around the user's waist, elastic cord means fixedly connected to said belt means at the center portion thereof, and end means operatively connected to end portions of said elastic cord means and adapted to be used for exercising the upper body of the user while walking, running, doing aerobics and other exercises, wherein said end means includes hand grips, and a wrist cuff operatively connected adjacent each of said hand grips, wherein said hand grip and wrist cuff are formed as interconnected units, and wherein said interconnected units include an intermediate body having the wrist cuff secured to one end thereof and a grip holster secured to the other end thereof, said grip holster adapted to receive the hand grip therein.

2. The exercise device described in claim 1, and a flexible grip lock strip secured at one end thereof to an edge portion of said intermediate body, and adaptable to being wrapped around said hand grip, with the other end thereof secured to said one end of said flexible grip lock strip by connector means.

3. The exercise device described in claim 2, wherein said connector means includes hook and loop strips.

4. An exercise device for the upper body of a user, the exercise device comprising belt means adapted to be worn around the user's waist, an elastic cord fixedly connected at a central portion thereof to the center portion of said belt means, and end means connected to end portions of said elastic cord, and attachment means for securing said elastic cord to fixed points on said end means and adapted to be used for exercising the upper body of the user while walking, running, jogging, doing aerobics, calisthenics, standing, sitting, tiding a stationary bicycle or other exercises, wherein said attachment means is a flexible grip lock strip secured around said end means and the end portions of said elastic cord.

5. The exercise device described in claim 4, wherein said end means includes hand grips.

6. The exercise device described in claim 4, wherein said end means includes wrist cuffs.

7. The exercise device described in claim 4, wherein said end means includes a hand grip and an adjacent wrist cuff, both said hand grip and said wrist cuff being operatively connected adjacent each end of said elastic cord.

8. The exercise device described in claim 5, wherein said attachment means is the hand grip and the end portion of said elastic cord.

9. An exercise device for the upper body of a user, the exercise device comprising belt means adapted to being worn around the user's waist, elastic cord means fixedly connected to said belt means at the center portion thereof, and end means operatively connected to end portions of said elastic cord means and adapted to be used for exercising the upper body of the user while walking, running, doing aerobics and other exercises, wherein said elastic cord means is a single elastic member having a central portion thereof removably secured to said center portion of said belt means, and wherein said belt means includes a two piece belt, a cord adjuster fastener means interconnecting said two piece belt and a cord anchor means.

10. The exercise device described in claim 9, wherein said cord adjuster fastener means includes a flat plate having a center hole intermediate two belt fastening slots for operatively attaching said cord adjuster fastener means to said belt means, and wherein said central portion of said elastic cord means is pulled through said center hole, wrapped around said cord adjuster fastener means, and pulled back through said center hole to removably and adjustably fasten said elastic cord means to said belt means.

11. The exercise device described in claim 10, wherein said elastic cord anchor means includes strip fasteners operatively connected to the central portion of said elastic cord means and to a side portion of said belt means for removably anchoring said central portion of said elastic cord means to different portions on said belt means.

12. An exercise device for the upper body of a user, the exercise device comprising belt means adapted to being worn around the user's waist, elastic cord means fixedly connected to said belt means at the center portion thereof, and end means operatively connected to end portions of said elastic cord means and adapted to be used for exercising the upper body of the user while walking, running, doing aerobics and other exercises, wherein said end means includes hand grips, a wrist cuff operatively connected adjacent each of said hand grips, and first connector means on said wrist cuff and second connector means on said hand grip, a non elastic cord of predetermined length secured to each of said first and second connector means, and a guide secured to said wrist cuff, with said elastic cord means slidably mounted through said guide.

13. The exercise device described in claim 12, wherein said connector means on said wrist cuff is a folded over end of said wrist cuff with said folded over end sewn to the underlying wrist cuff, and said connector means on said hand grip is an opening formed therethrough adjacent one end thereof.

14. An exercise device for the upper body of a user, the exercise device comprising belt means adapted to being worn around the user's waist, elastic cord means fixedly connected to said belt means at the center portion thereof, and end means operatively connected to end portions of said elastic cord means and adapted to be used for exercising the upper body of the user while walking, running, doing aerobics and other exercises, wherein said end means includes hand grips, and a wrist cuff operatively connected adjacent each of said hand grips, wherein said hand grip and wrist cuff are formed as interconnected units, and flexible holding means operatively connected to said hand grip for retaining an end portion of said elastic cord means in place against said hand grip.

15. An exercise device for the upper body of a user, the exercise device comprising belt means adapted to being worn around the user's waist, elastic cord means fixedly connected to said belt means at the center portion thereof, and end means operatively connected to end portions of said elastic cord means and adapted to be used for exercising the upper body of the user while walking, running, doing aerobics and other exercises, wherein said end means includes hand grips, wherein each said hand grip includes a tubular handle with a plastic strap extended therethrough and connected together at the ends thereof, and with the end of said elastic cord means connected to said plastic strap.

16. An exercise device for the upper body of a user, the exercise device comprising belt means adapted to being worn around the user's waist, elastic cord means fixedly connected to said belt means at the center portion thereof, and end means operatively connected to end portions of said elastic cord means and adapted to be used for exercising the upper body of the user while walking, running, doing aerobics and other exercises, wherein said end means includes hand grips, wherein each said hand grip includes a tubular handle and a cord adjuster fastener means, and wherein said cord adjuster fastener means includes a plastic hand grip strap extending longitudinally through and around said tubular handle, a cord adjuster fastener and a hook and loop fastener sewn to said cord adjuster fastener, wherein the middle of said cord adjuster fastener is sewn to said plastic grip strap on the outside of said tubular handle and fastens around said tubular handle, and wherein an end of said elastic cord means extends longitudinally through said tubular handle and is removably and adjustably secured to said tubular handle by said hook and loop fastener of said cord adjuster fastener.

17. The exercise device described in claim 16, and a wrist cuff operatively connected adjacent each said hand grip, and a guide secured to the inside of the upper portion of said wrist cuff, and upper and lower connector straps, wherein one end of said lower connector strap is secured to said plastic grip strap adjacent the bottom of said hand grip and the other end of said lower connector strap is secured to the bottom of said wrist cuff, and one end of said upper connector strap is secured to said plastic grip strap adjacent the top of said hand grip and the other end of said upper connector strap is secured to said wrist cuff guide, with said elastic cord means slidably mounted through said guide.

18. An exercise device for the upper body of a user, the exercise device comprising belt means adapted to being worn around the user's waist, elastic cord means fixedly connected to said belt means at the center portion thereof, and end means operatively connected to end portions of said elastic cord means and adapted to be used for exercising the upper body of the user while walking, running, doing aerobics and other exercises, wherein said elastic cord means is a single elastic member having a central portion thereof removably secured to said center portion of said belt means, and wherein said belt means includes a belt fastener fixedly connected to said center portion of said belt means, and said central portion of said elastic cord means is removably secured to said belt fastener, and wherein said belt fastener includes a plastic D fastener, and a plastic fastening strap, wherein said plastic fastening strap is placed through said D fastener and sewn at both ends to said belt means in order to secure said D fastener to said belt means.

19. An exercise device for the upper body of a user, the exercise device comprising belt means adapted to being worn around a user's waist, elastic cord means having a central portion thereof fixedly connected to said belt means at the center portion thereof, and end means operatively connected to end portions of said elastic cord means, wherein said belt means includes an adjuster fastener means for removably securing said elastic cord means at a selected length to said belt means and for frictionally holding said elastic cord means at said selected length, and an anchor means for holding said cord means in a fixed position on said belt means, and adapted to be used for exercising the upper body of the user while walking, running, jogging, doing aerobics or other exercises.

20. An exercise device for the upper body of a user, the exercise device comprising belt means adapted to being worn around the user's waist, elastic cord means fixedly connected to said belt means at the center portion thereof, and end means operatively connected to end portions of said elastic cord means, and adapted to be used for exercising the upper body of the user while walking, running, jogging, doing aerobics or other exercises, wherein said elastic cord means includes a central portion thereof removably secured to said center portion of said belt means, and wherein said belt means includes a cord adjuster fastener means and a cord anchor means.

* * * * *